United States Patent [19]

Haftmann et al.

[11] Patent Number: 4,877,347

[45] Date of Patent: . Oct. 31, 1989

[54] KEYBOARD FOR TYPEWRITERS OR SIMILAR MACHINES

[75] Inventors: Johannes Haftmann, Schwabach; Rudolf Schmeykal, Hemhofen, both of Fed. Rep. of Germany

[73] Assignee: Ta Triumph-Adler Aktiengesellschaft, Nuremberg, Fed. Rep. of Germany

[21] Appl. No.: 125,451

[22] Filed: Nov. 25, 1987

[30] Foreign Application Priority Data

Jul. 9, 1987 [DE] Fed. Rep. of Germany ..... 3722616

[51] Int. Cl.[4] ..... B41J 5/08

[52] U.S. Cl. ..... 400/479; 400/490; 200/5 D; 200/341

[58] Field of Search ..... 400/472, 473, 474, 475, 400/476, 477, 479, 479.1, 479.2, 490, 491, 495, 495.1, 682, 694; 200/5 A, 5 D, 5 E, 243, 293, 295, 328, 340; 340/365 R

[56] References Cited

U.S. PATENT DOCUMENTS

| | | | |
|---|---|---|---|
| 3,705,276 | 12/1972 | Seeger, Jr. et al. | 200/5 A |
| 3,826,882 | 7/1974 | Giolitti et al. | 340/365 R X |
| 3,900,712 | 8/1975 | Fukao | 400/419.1 X |
| 3,909,564 | 9/1975 | Scheingold et al. | 400/479 X |
| 3,964,593 | 6/1976 | Pointon | 400/491.3 |
| 3,999,025 | 12/1976 | Sims, Jr. | 200/5 A X |
| 4,251,703 | 2/1981 | Hoeft et al. | 200/340 |
| 4,528,428 | 7/1985 | Gotoh et al. | 400/479.1 X |
| 4,602,138 | 7/1986 | Berutto et al. | 200/295 X |
| 4,689,608 | 8/1987 | Bolda et al. | 340/365 R X |
| 4,707,578 | 11/1987 | Burkhardt | 200/5 A X |
| 4,713,507 | 12/1987 | Burkhardt | 200/5 A X |

FOREIGN PATENT DOCUMENTS

| | | | |
|---|---|---|---|
| 3007239 | 9/1981 | Fed. Rep. of Germany . | |
| 3045354 | 3/1983 | Fed. Rep. of Germany . | |
| 3225696 | 1/1984 | Fed. Rep. of Germany . | |
| 3331279 | 3/1984 | Fed. Rep. of Germany . | |
| 0009830 | 1/1981 | Japan | 340/365 R |
| 2124156 | 2/1984 | United Kingdom . | |

OTHER PUBLICATIONS

IBM Technical Disclosure Bulletin, "Keyboard Assembly", Duranske, vol. 20, No. 9, Feb., 1978, p. 3614.

*Primary Examiner*—Ernest T. Wright, Jr.
*Attorney, Agent, or Firm*—Browdy and Neimark

[57] ABSTRACT

A keyboard for typewriters or similar machines has a key support, switching contacts and key push rods, each of which is acted upon by a spring. The design of the few individual parts assures their simple manufacture (extruded parts and a stamped part) as well as an assembly just as simple and therefore automated, and, if desired, even without screws or aids of that type. Activation of the individual keys takes place with satisfactory tactile feedback and without undesireable vibrations.

7 Claims, 1 Drawing Sheet

KEYBOARD FOR TYPEWRITERS OR SIMILAR MACHINES

The invention relates to a keyboard for typewriters or similar machines with a key support, switching contacts and individual key push rods with keys which are biased by a resilient tongue formed out of a bed plate.

BACKGROUND OF THE INVENTION

Clearly defined demands are required of keyboards of the type noted above. It must be possible to operate them easily and safely since they are the interface between man and machine. They must be dependable so that no input commands are lost. They also must be inexpensive and suitable for automatic production to the extent possible.

Known keyboards have not been able to meet all of these requirements. They either consist of so many components that they are cumbersome to make and assemble or they do not fulfill the requirement of easy operation. The former is the case in a keyboard known from German Laid-open Application No. DE-OS 32 25 696. With that keyboard it is additionally required to attach electrically conductive clamps on resilient bars of an insulating material. A keyboard with individual keys of the type described in German Pat. No. DE-PS 30 45 354 is not easy to operate because it does not feel comfortable. The type of key described in this patent is more suitable as a single key and not as a key in a keyboard such as required, for example, in a typewriter.

SUMMARY OF THE INVENTION

It is an object of the present invention to provide a keyboard consisting of only a few components and capable of being assembled automatically as much as possible. In spite of this, the keyboard should be dependable in operation and feel comfortable when operated. A keyboard which is characterized in that guides for the key push rods are provided in the key support on the one hand and spacers with drop-in pins for the spring bed plate on the other and in that the key push rods, which can be inserted from above through a respective cut-out in the spring bed plate and in the key support, can be locked in a corresponding guide and in that switching contacts can be closed by means of a die-cast contact bridge when a key push rod is activated is suitable for this purpose. Such a keyboard only has a few components which can be formed as die-cast plastic parts or as stamped parts. The key support and the spring bed plate can be easily assembled since they fit into each other. The key push rods are then inserted from above through cut-outs in the spring bed plate and in the key support and lock in automatically, i.e. the key push rods can no longer be inadvertently pulled out upwardly. A resilient tongue is provided on the spring bed plate for each key and extends into the cut-out for the key push rod. By means of an edge, each key push rod is supported on its resilient tongue which returns it into the position of rest after each operation. The guides on the key support are fashioned so that the inseted key push rod cannot twist. The keyboard can be placed on a contact plate and both parts can be removably connected by means of spring hooks. However, the connection can also be made by means of screws or rivets. The assembly of the parts can be performed automatically. The key push rods can be extruded from plastic in a two-component extruder having a contact bridge made of a resilient and electrically conductive material. Several key push rods with their connecting pieces (lugs) can be extruded together by the machine. Afterwards, for example, when the lugs of the contact bridges have been removed, all key push rods combined in a component can be assembled at one time. This way there are no mix-ups and it is unnecessary to sort the keys. Of course the removal of the connecting pieces can take place prior to the insertion of the key push rods into the key support. It makes no difference whether the printing of the keys is performed prior to or after assembly.

The embodiment of a keyboard having a resilient tongue cutout of the bed plate which locks with a drop-in pin of the key support when the bed plate is placed on the spacers has the advantage of a simple and secure connection between the key support and the spring bed plate by means of the locking relationship between the drop-in pin of the key support and the bed plate. This also particularly emphasizes the possibility of automatic production. The fact that a plate carrying the switching contacts is fastened to the key support by means of spring hooks also aids in this advantage by providing a secure connection between the key support and the plate.

An exemplary embodiment of the invention is shown in a schematic view in the drawings.

DETAILED DESCRIPTION OF THE PREFERRED EMBODIMENT

Figure 1:
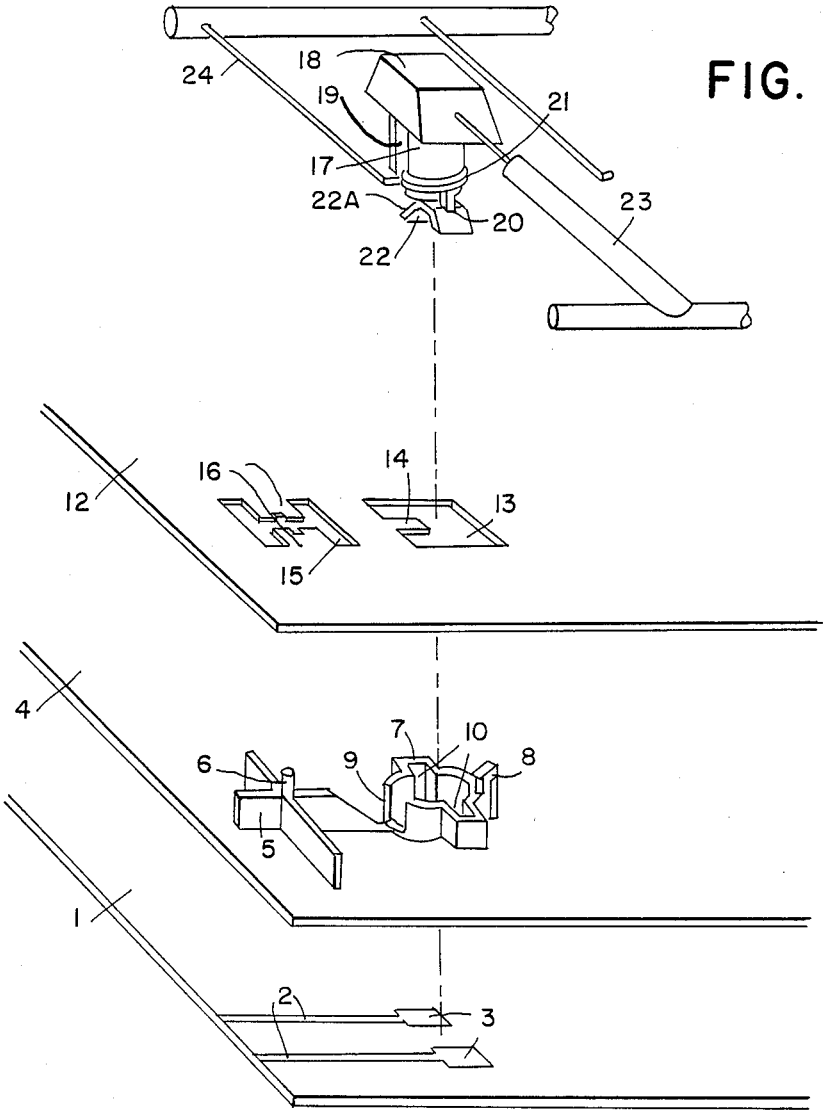
FIG. 1 is an exploded perspective view of the individual parts of a keyboard.

A plate 1 having printed circuits 2 and switching contacts 3 is shown in FIG. 1. The switching contacts 3 are bridged by activation of the keys.

The key support 4 has been made into a single plastic in one piece by means of an extrusion process. Spacers 5 with a dropin pin 6 are formed on the key support 4. Their arrangement and number can be made dependent on the size of the keyboard. It is also possible to provide such a spacer 5 with a drop-in pin 6 for each key. In addition, guides 7 are die-cast in the key support 4, each having a spring hook 8 and a slot 9. The spring hook 8 and the slot 9 are placed opposite each other. Offset by 90° with respect to the slot 9 and the spring hook 8 are two protrusions 10. A cut-out 11 (FIG. 2) is provided in the center of the guides 7 and extends through the key support 4.

A spring bed plate 12 is made of spring steel and represents a simple stamped part without bent edges. This results in low fabricating costs. In general the size of the spring bed plate 12 corresponds to the dimensions of the key carrier 4. There are also cut-outs 13 in the spring bed plate 12 which are disposed such that they come to rest exactly atop the cut-outs 11 in the key support 4 when key support 4 and spring bed plate 12 are placed on top of each other as provided. A resilient tongue 14 extending into the cut-out 13 is disposed on the spring bed plate 12 in the area of the slot 9 on the guide 7 of the key support 4.

H-shaped cut-outs 15 are also disposed on the spring bed plate 12 such that two opposing resilient flaps 16 result. The number and position of these cut-outs 15 corresponds to the number and position of the drop-in pins 6 on the key support 4.

The key push rods 17 are made of plastic and each has on its upper end a key 18. Protrusions 19 and 20 are formed on the key push rod 17 and correspond to the slot 9 and the protrusions 10 of the guide 7 on the key support 4. Each key push rod 17 has on its lower end an edge 21 which is used to interact with the spring hook 8 on the key support 4. Furthermore, on the underside of each key push rod 17 an electrically conductive contact bridge 22 made of a material which is more resilient than that from which the key push rod 17 has been die cast. The distance of the arms 22A of the contact bridge 22 corresponds to the distance between the switching contacts 3. The resiliency of the contact bridge 22 aids in the determination of the feeling of the keys 18 desired. As soon as the arms 22A of the contact bridge 22 have reached the switching contacts 3, the operator receives a signal showing the acceptance of the order transmitted. If the key push rod 17 is to be further operated by the finger, this must be done against the resistance of the resilience of contact bridge 22. However, by means of this arrangement it becomes possible to dependably avoid the unwanted vibration of the keys 18 which would be transferred to the fingers of the operator.

It would be logical for reasons of ease of assembly to form several key push rods 17 or possibly all of them for an entire keyboard in one extrusion step in the machine. In connection with the keys this possibility has already been achieved in the German Laid-open Application No. DE-OS 32 25 696. In the present case the connecting pieces (lugs) 23 of the key push rods 17 and connecting pieces 24 of the contact bridges 22 can also be extruded so that the key push rods 17 remain connected to each other until a particular assembly phase has been reached. If the connecting pieces 23 of the key push rods 17 are only to be removed when the key push rods 17 are to be inserted into the guides 7 in the key support 4, the connecting pieces 24 of the contact bridges 22 must be removed prior to this. Printing of the keys 18 can take place prior to or after insertion of the key push rods 17 into the guides 7.

Spring hooks 25 on the key support 4, which engage in corresponding recesses 26 of the plate 1, are also suitable to connect the key support 4 with the plate 1. Alternatively, the plate 1 can be screwed or riveted to the key support 4.

Figure 2:
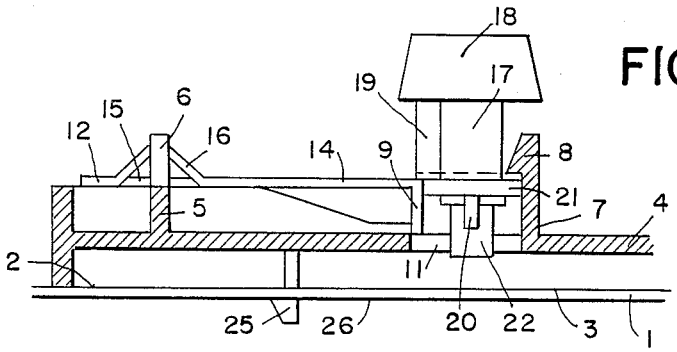
FIG. 2 is a partial section through an assembled keyboard.

After the individual parts—plate 1, key support 4, spring bed plate 12 and key push rods 17—have been manufactured, assembly can begin. The key support 4 is united with the spring bed plate 12 in the manner described. Then the key push rods 17 can be inserted from above. It is possible to lift and transport the key push rods by means of a vacuum suction device. When the key push rods 17 are inserted into the cut-out 11 in the key support 4, the edge 21 pushes the spring hook 8 aside and it moves back again after passing the upper portion of the edge 21. It then limits the movement of a key push rod 17 after its activation. The restoration of each key push rod 17 is performed by the resilient tongue 14 which rests, for example, against the lower part of a protrusion 19 as shown in FIG. 2. After removal of the connecting pieces 23 from the key push rods 17 only the assembly of the plate 1 to the underside of the key support 4 is required. The connection of the key push rods 17 to the connecting pieces 23 does not have to take place at the keys 18, as shown in FIG. 1. Connection should be made where eventually remaining pieces do not mar the appearance of the keys 18 where the function of the keys 18 is not impaired.

It is to be understood that the embodiment of the invention described above has been given by way of example only and that further improvements and variants are possible within the scope of the invention.

What is claimed is:

1. A keyboard for typewriters or similar machines having a key support, switching contacts and individual key push rods with keys, and a bed plate, with guides for the key push rods being provided in the key support, comprising:

spacers having a drop-in pin for engagement with the bed plate and provided on the key support;

resilient flaps cut-out of the bed plate which, when the bed plate is placed on the spacers, are locked to the drop-in pin of the key support;

means defining cut-outs cut in the bed plate and the key support for receiving, from above, corresponding key push rods;

a spring hook disposed on the guide which extends behind an edge on the key push rod when the key push rods are stopped in the correspondingly assigned guide and in this way limits movement of the key push rod against the direction of operation;

a resilient tongue formed out of the bed plate for activating the key push rods and extending behind a protrusion on the key push rod for maintaining the key push rod in a position in which the spring hook rests against the edge;

a contact bridge diecast on the key push rod; and switching contacts closeable by the contact bridge when the key push rod is activated.

2. A keyboard in accordance with claim 1, wherein said contact bridge consists of resilient and electrically conductive material.

3. A keyboard in accordance with claim 2, wherein a plate carrying the switching contacts is fastened to the key support by means of spring hooks.

4. A keyboard in accordance with claim 1, wherein a plate carrying the switching contacts is fastened to the key support by means of spring hooks.

5. A keyboard for typewriters or similar machines comprising:

key push rods associated with keys for the keyboard and having an edge protruding therefrom;

a key support having guides for the key push rods;

a bed plate having resilient flaps formed therein;

spacers disposed between the key support and the bed plate and having a drop-in pin for engagement with the resilient flaps of the bed plate;

means defining cut-outs in the bed plate and the key support in positions corresponding to the position of the guides for receiving corresponding key push rods;

a spring hook disposed on the guide for engagement behind the edge of the key push rod when the key push rod is inserted into the respective guide for limiting movement of the key push rod against the direction of operation;

a resilient tongue formed out of the bed plate for activating the key push rods and extending behind a protrusion on the key push rod for maintaining the key push rod in a position in which the spring hook rests against the edge;

a contact bridge diecast on the key push rod; and switching contacts closeable by the contact bridge when the key push rod is activated.

6. A keyboard in accordance with claim 5, wherein said contact bridge consists of resilient and electrically conductive material.

7. A keyboard in accordance with claim 5, further comprising:

a plate carrying the switching contacts; and spring hooks for fastening the plate to the key support.

* * * * *